US005980243A

United States Patent [19]

Surbey et al.

[11] Patent Number: 5,980,243

[45] Date of Patent: Nov. 9, 1999

[54] FLAT FLAME

[75] Inventors: David J. Surbey, Bixby; John McDonald, Broken Arrow; Tim Kirk, Morris; Rex K. Isaacs; Darton J. Zink, both of Tulsa, all of Okla.

[73] Assignee: Zeeco, Inc., Broken Arrow, Okla.

[21] Appl. No.: 09/267,249

[22] Filed: Mar. 12, 1999

[51] Int. Cl.[6] ..... F23D 14/12

[52] U.S. Cl. ..... 431/347; 431/174; 431/181; 431/252; 431/285

[58] Field of Search ..... 431/347, 348, 431/174, 178, 179, 181, 252, 285, 115, 116, 278

[56] References Cited

U.S. PATENT DOCUMENTS

| | | | |
|---|---|---|---|
| 3,033,273 | 5/1962 | Zink, Jr. et al. | 431/285 |
| 3,771,944 | 11/1973 | Hovis et al. | 431/284 |
| 3,876,362 | 4/1975 | Hirose | 431/9 |
| 3,915,621 | 10/1975 | Iverson | 431/189 |
| 3,924,574 | 12/1975 | Ebeling | 122/23 |
| 3,954,382 | 5/1976 | Hirose | 431/9 |
| 4,009,989 | 3/1977 | Bitterlich | 431/178 |
| 4,231,735 | 11/1980 | Downs | 431/328 |
| 4,257,763 | 3/1981 | Reed | 431/174 |
| 4,451,230 | 5/1984 | Bocci et al. | 431/284 |
| 4,496,306 | 1/1985 | Okigami et al. | 431/8 |
| 4,505,666 | 3/1985 | Martin et al. | 431/285 |
| 5,073,105 | 12/1991 | Martin et al. | 431/116 |
| 5,098,282 | 3/1992 | Schwartz et al. | 431/9 |
| 5,118,284 | 6/1992 | Mutchler | 431/10 |
| 5,154,596 | 10/1992 | Schwartz et al. | 431/9 |
| 5,238,395 | 8/1993 | Schwartz et al. | 431/10 |
| 5,269,678 | 12/1993 | Schwartz et al. | 431/9 |
| 5,271,729 | 12/1993 | Gensler et al. | 431/175 |
| 5,344,307 | 9/1994 | Schwartz et al. | 431/9 |
| 5,458,481 | 10/1995 | Surbey et al. | 431/115 |
| 5,545,031 | 8/1996 | Joshi et al. | 431/8 |
| 5,554,022 | 9/1996 | Nabors, Jr. et al. | 431/10 |
| 5,575,637 | 11/1996 | Slavejkov et al. | 431/8 |
| 5,611,682 | 3/1997 | Slavejkov et al. | 431/8 |

*Primary Examiner*—James C. Yeung
*Attorney, Agent, or Firm*—Head, Johnson & Kachigian

[57] ABSTRACT

A burner for combusting fuel gas and air in an enclosure having a burner block member of non-combustible material, such as ceramic, having a central rectangular or square opening. Said burner block being located between the surface to be heated and an enclosure wall opposite said surface, said central rectangular or square block opening being used to shape the combustion flame in a flat or fan shaped fashion parallel to the enclosure wall surface. In such an arrangement, the burner's purpose is to direct combustion flame upon the enclosure wall which is heated by the flame and radiates heat back towards the surface area to be heated and to reduce the oxygen content which serves to reduce the peak flame temperature of the combustion process to thereby reducing $NO_x$ production.

6 Claims, 3 Drawing Sheets

FLAT FLAME

BACKGROUND OF THE INVENTION

This invention relates to a burner for combusting air and a fuel gas where the fuel gas enters the combustion chamber through a rectangular opening and the primary fuel gas jets use Venturi type action to induce mixing of furnace gas with the fuel gas before reaching the combustion air. The method results in a further reduction of oxides of nitrogen in the exhaust gas over existing technology.

Fuel gas is burned by mixing air with it, oxygen from the air being combined with carbon and hydrogen present in the gas with the release of substantial heat. If gas is thoroughly mixed with air and combustion is carried out under ideal conditions the results of the combustion are primarily carbon dioxide and water in vapor form. These components are commonly found in the atmosphere and are essentially free of hazard to the environment. However, when a gas is burned in a high temperature, excess air environment, a portion of the nitrogen, which makes up a major component of the atmosphere, will react with oxygen in the atmosphere to produce oxides of nitrogen ($NO_x$). It is well known that, other conditions being equal, $NO_x$ production increases as the temperature of the combustion process increases. Oxides of nitrogen gases are considered to be an environmental hazard.

The present invention further reduces emission of $NO_x$ while providing the required heat generation.

SUMMARY OF THE INVENTION

The present invention describes a burner system, which is designed to combust fuel gas and air against an adjacent enclosure wall. The combustion against the enclosure wall creates heat which is radiated across the enclosure space to the process tubes which pass the feed stock, wherein the chemical process is to take place.

The burner has a rectangular and/or square rather than the standard circular opening, which allows the combustion air which flows through the opening along the enclosure wall surface where combustion can occur. Such a design allows the combustion pattern to provide a nearly uniform heat distribution along the enclosure wall surface, which in turn, radiates heat back toward the process tubes or other surface desired to be heated.

Furthermore, the new process allows the combustion to take place at the enclosure wall with the air, furnace gases and fuel gas being mixed prior to reaching the combustion area. In this manner, the combustion takes place at a reduced peak flame temperature and thus reduces $NO_x$ emission. By further shaping the area where the combustion takes place against the enclosure wall, the new system provides a more desirable heat flux profile which allows for better efficiency in heating, thus, obtaining the required process heating at a lower peak flame temperature, resulting in the lower $NO_x$ emissions.

The burner block has a rectangular and/or square opening which is placed parallel to the enclosure wall. The burner block is installed in the floor of the enclosure adjacent to the enclosure wall against which the combustion flame will be directed. Said enclosure wall is opposite the surface to be heated such as process tubes through which feedstock fluids or gases are heated to a desired temperature.

The burner block rectangular and/or square opening has a bottom through which the combustion air is introduced, and a top, through which a mixture of combustion air, fuel gas and some furnace gases exit the burner block and enters the enclosure.

The walls of the burner block contain fuel gas/furnace gases injection passageways, and burner flame shaping gas injection means. The fuel gas/furnace gas injection passageways may be located either parallel to or perpendicular to the enclosure wall against which the combustion takes place. Each of such passageways is open at the top and closed at the bottom. The passageways also have an opening from said passageways horizontally into the burner block central rectangular and/or square opening.

A fuel gas inlet pipe is installed inside each of the injection passageways entering through the bottom and extending upward to the horizontal passageway. The tip or nozzle of the fuel gas pipe or conduit is situated such that the fuel gas is directed out of the fuel gas pipe through the horizontal passageway of the burner block wall into the burner block central rectangular and/or square opening.

The fuel gas being under pressure, when thus injected causes furnace gases to enter the injection passageway from the top of the burner block wall or side end of the passageway and to combine with the fuel gas to flow through the horizontal passageway into the burner block central rectangular and/or square opening due to the differential pressure.

The fuel gas is thus mixed with furnace gases before reaching the air stream, causing the resulting mixture to burn at a lower peak flame temperature than fuel gas mixed with air alone.

A further improvement consists of additional fuel gas insertion means which consist of pipes located in the narrow walls of the burner block. The fuel gas pipes enter the burner block at the bottom and extend the full height of the burner block, with the tip or nozzle of said fuel gas outlets above the block, being aimed at the enclosure wall such as to shape the burner flame on the wall of the enclosure. The location of the flame shaping gas jets on the sides of the central rectangular burner opening, causes the fuel to have to cross through and mix with furnace gases before reaching and mixing with the combustion air stream, thus again causing the mixture to burn at a lower peak flame temperature and lowering $NO_x$ production.

The burner is thus configured to provide a flat flame with a slower combustion reaction speed, which will produce the same heat release at a lower peak flame temperature, all of which reduces $NO_x$ production.

DETAILED DESCRIPTION OF THE PREFERRED EMBODIMENTS

Figure 1:
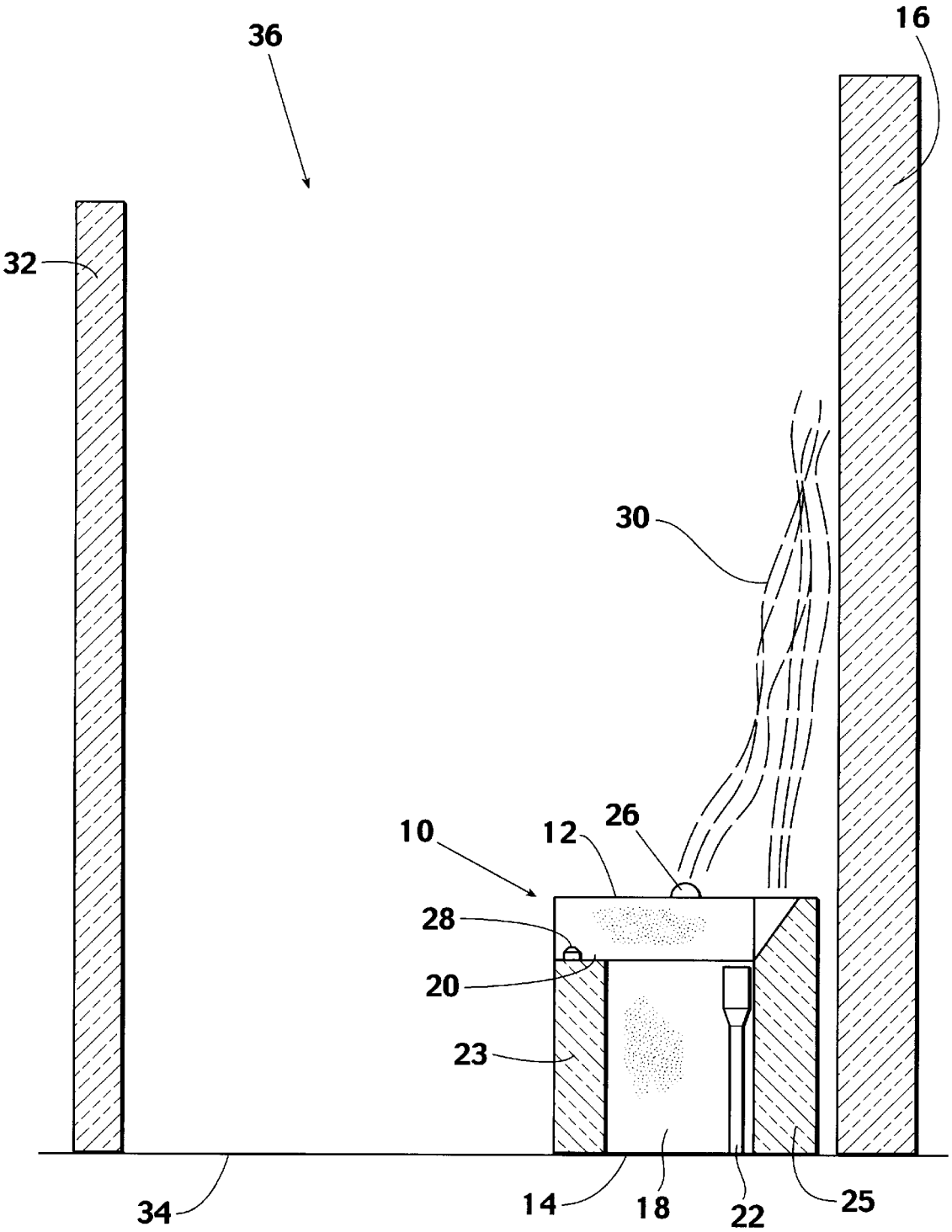
FIG. 1 is a cross-section illustrative view of the present invention.

Referring to FIG. 1 illustrates an enclosure 36 having an enclosure wall 16, enclosure wall 34 and surface to be heated 32 with burner block 10 contained therein. Wall 16 maybe formed of metal and have insulating material such as ceramic tile affixed thereto. Burner block 10 has an outlet end 12 and an inlet end 14. Outlet end 12 is in communication with the interior of enclosure 36 in which combustion takes place. Block 10 has a rectangular or square central opening 18 and in the preferred embodiment it's external dimensions are also rectangular or square.

Figure 2:
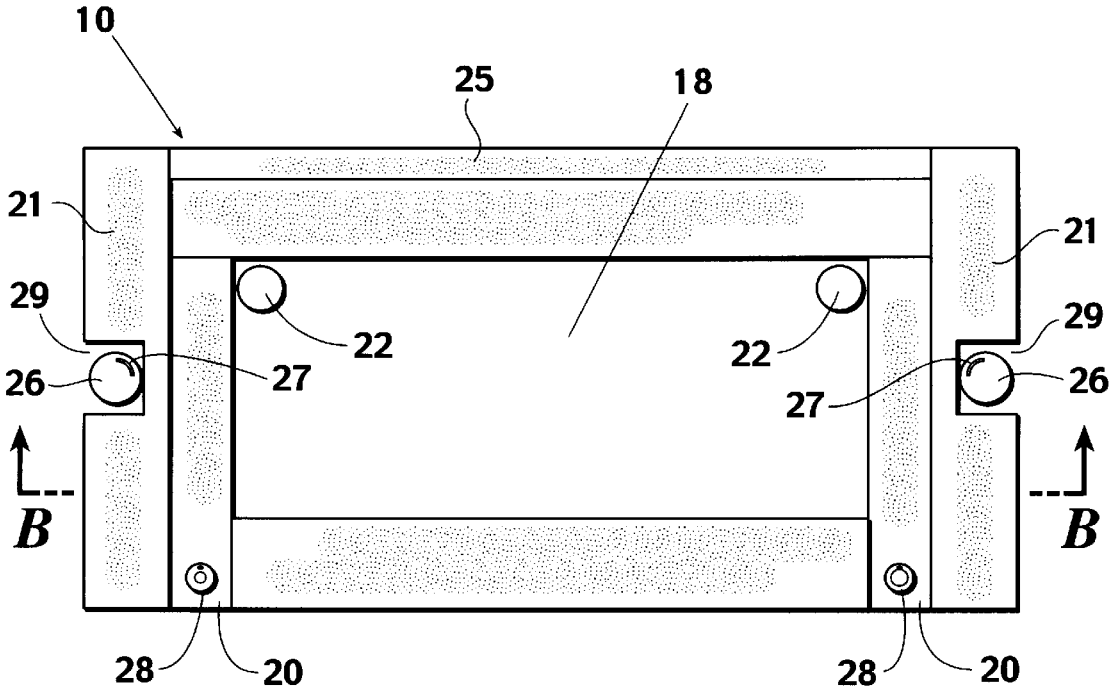
FIG. 2 is a top view of the burner block of the present invention.

Referring now to FIG. 2 a top view of burner block 10 is shown having front wall 25, burner side 23, and two burner ends 21 positioned in such a manner as to create a rectangular or square dimension. Further, by this arrangement rectangular or square central opening 18 is formed. In addition, each burner end has a stabilization ledge 20 cut out of its interior upper portion.

Burner block 10 utilizes a process known as staging fuel which means that fuel gas is introduced for combustion at two different levels in the burner. In the present embodiment two primary gas tips 28 are located along each stabilization ledge proximate to the burner side 23. Two stage gas tips 26 are positioned within openings 29 contained within each burner end 21. Each stage gas tip 26 has orifices 27 drilled to distribute the fuel gas in a flat or fanned shaped pattern parallel to the enclosure wall 16. As the primary and stage fuel gas tips release fuel gas a venturi action is created from the sudden expansion of the fuel gas which in turn pulls furnace gas around the primary and stage fuel gas tips and is mixed with the fuel gas. The fuel and furnace gas mixture from the primary gas tips travels along each stabilization ledge 20 to a pilot 22 located within the rectangular or square central opening 18 and in front of primary gas tip 28. As this mixture travels along the stabilization ledge 20 it is mixed with small amounts of air and combustion takes place. The flame from the primary fuel mixture then ignites the fuel and furnace gas mixture from the stage gas tip 26. Fuel gas flame 30 from the stage gas tip 26 travels along the enclosure wall 16 and is mixed with small amounts of air as it moves and combusts.

The process of staging the fuel, mixing the fuel gas with the furnace gases, and the combustion products that have reduced oxygen levels in keeping the fuel gas mixtures from the air reduces the amount of $NO_x$ or oxides of nitrogen that is produced by combustion.

Figure 3:
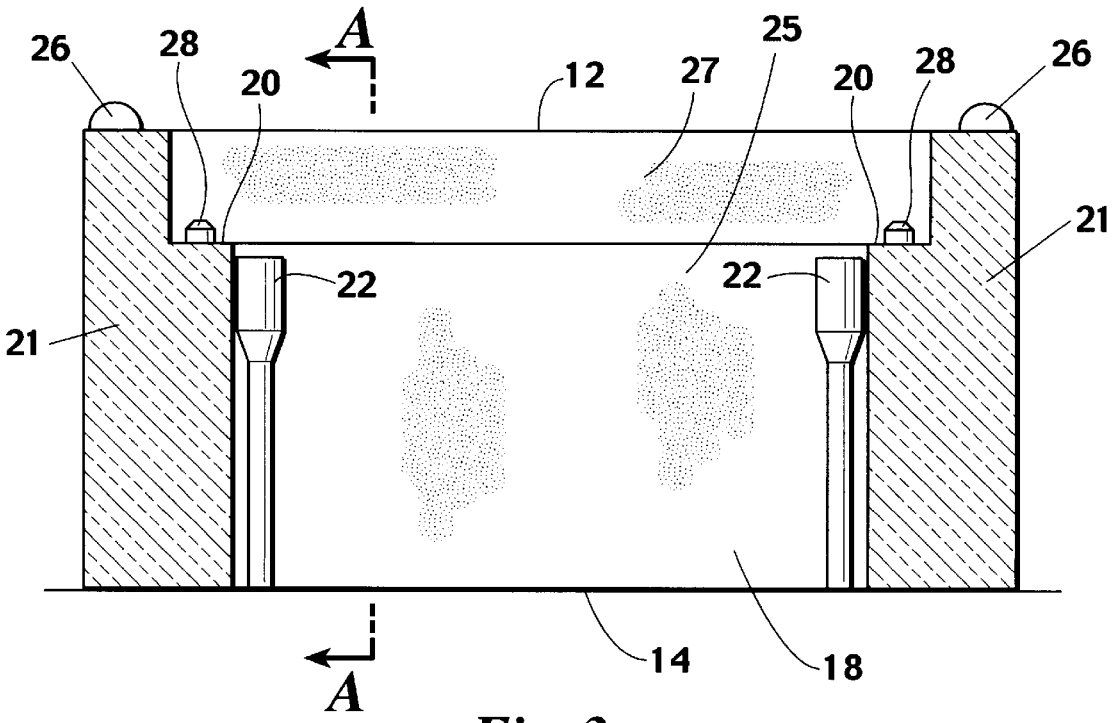
FIG. 3 is a cross-section view of the burner block of the present invention along line B—B as shown in FIG. 2.

FIG. 3 illustrates a cross-sectional view of burner block 10. Primarily, this figure demonstrates the relative placement of each gas tip within burner block 10. Further, FIG. 3 illustrates relative placement of each stabilization ledge 20.

Figure 4:
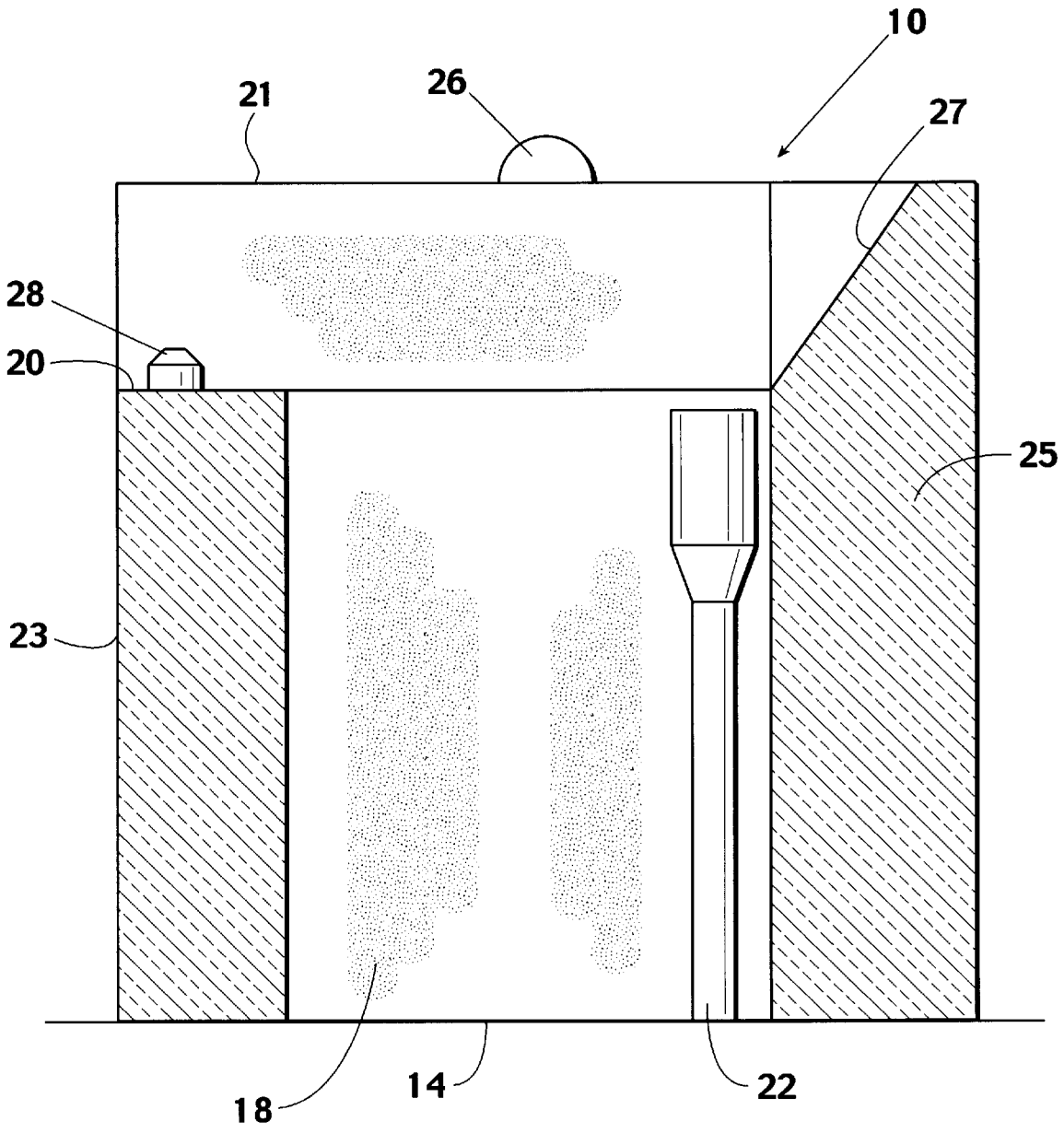
FIG. 4 is a cross-sectional view of the burner block of the present invention along line A—A as shown in FIG. 3.

FIG. 4 illustrates a cross-sectional view taken along line A—A as demonstrated in FIG. 3. This figure demonstrates the relative placement of the primary gas tip 28, the stage gas tip 26 and the pilot 22.

As shown in FIG. 4, front wall 25 is illustrated having a slant 27 located in its upper portion. It is understood that front wall 25 may or may not include slant 27 in alternative embodiments.

The means of directing air through the burner is not specifically illustrated since such are standard in the industry and may be forced draft or natural draft or other well known means.

The claims and the specifications describe the invention presented and terms that are employed in the claims draw their meaning from the use of such terms in the specification. The same term is employed in the prior art may be broader in meaning than specifically employed herein whenever there is a question between the broader definition of such terms used in the prior art and the more specific use of the terms herein the more specific meaning is meant.

While the invention has been described with a certain degree of particularity, it is manifest that many changes may be made in the details of construction and the arrangement of components without departing from the spirit and scope of this disclosure. It is understood that this invention is not limited to the embodiments set forth herein for purposes of explempification but is limited only by the scope of the attached claim or claims including the full range of equivalency to which each claim therein is entitled.

Whereas, the present invention has been described in relation to the drawings attached hereto, it should be understood that other and further modifications, apart from those shown or suggested herein, may be made within the spirit and scope of this invention.

What is claimed is:

1. A low $NO_x$ burner for combusting fuel gas and air in an enclosure comprising:

a burner block having an inlet end and an outlet end and a central opening therethrough between the ends, said central opening being a generally rectangular shape having two side walls, an end wall and a front wall with each wall having an exterior side and an interior side, each side wall having a stabilization ledge located on its interior side proximate to the burner block outlet end, and the burner block outlet end being in communication with an enclosure to be heated by burning fuel gas;

at least one primary gas tip located along each stabilization ledge proximate to the end wall;

at least one stage gas tip located proximate each side wall;

at least one pilot located within the central opening proximate to the front wall and proximate to the stabilization ledge.

2. The burner of claim 1 wherein the number of primary gas tips located along each stabilization ledge is two.

3. The burner of claim 1 wherein the number of stage gas tips within each side wall is two.

4. The burner of claim 1 wherein the number of pilots is two.

5. The burner of claim 1 wherein the portion of the front wall proximate to the burner block outlet end is slanted.

6. The burner of claim 1 wherein each stage tip is located centrally within each side wall.

* * * * *